US006581696B2

(12) United States Patent
Giardino

(10) Patent No.: US 6,581,696 B2
(45) Date of Patent: Jun. 24, 2003

(54) PROCESSES OF DETERMINING TORQUE OUTPUT AND CONTROLLING POWER IMPACT TOOLS USING A TORQUE TRANSDUCER

(75) Inventor: David A. Giardino, Rock Hill, SC (US)

(73) Assignee: Chicago Pneumatic Tool Company, Rock Hill, SC (US)

( * ) Notice: Subject to any disclaimer, the term of this patent is extended or adjusted under 35 U.S.C. 154(b) by 134 days.

(21) Appl. No.: 09/872,121

(22) Filed: Jun. 1, 2001

(65) Prior Publication Data

US 2002/0020538 A1 Feb. 21, 2002

Related U.S. Application Data

(63) Continuation-in-part of application No. 09/204,698, filed on Dec. 3, 1998, now Pat. No. 6,311,786.

(51) Int. Cl.[7] ..... B25B 23/14

(52) U.S. Cl. ..... 173/1; 173/177; 173/180; 173/181; 73/862.23

(58) Field of Search ..... 173/1, 2, 176, 173/177, 180, 181, 182, 183; 81/467, 470; 73/862.23, 862.24, 862.36

(56) References Cited

U.S. PATENT DOCUMENTS

| | | | | | |
|---|---|---|---|---|---|
| 4,882,936 | A | | 11/1989 | Garshelis | |
| 5,181,575 | A | * | 1/1993 | Maruyama et al. | 173/180 |
| 5,289,886 | A | * | 3/1994 | Shikata et al. | 173/181 |
| 5,315,501 | A | * | 5/1994 | Whitehouse | 73/862.23 |
| 5,366,026 | A | * | 11/1994 | Maruyama et al. | 173/180 |
| 5,492,185 | A | * | 2/1996 | Schoeps et al. | 173/177 |
| 5,937,370 | A | * | 8/1999 | Lysaght | 73/862.21 |
| 6,311,786 | B1 | * | 11/2001 | Giardino et al. | 173/1 |

* cited by examiner

*Primary Examiner*—Scott A. Smith
(74) *Attorney, Agent, or Firm*—Schmeiser, Olsen & Watts

(57) ABSTRACT

An impact tool having a control system for turning off a motor at a preselected torque level.

39 Claims, 7 Drawing Sheets

PROCESSES OF DETERMINING TORQUE OUTPUT AND CONTROLLING POWER IMPACT TOOLS USING A TORQUE TRANSDUCER

This application is a continuation-in-part of application Ser. No. 09/204,698 with a filing date of Dec. 3, 1998 now U.S. Pat. No. 6,311,786.

BACKGROUND OF THE INVENTION

1. Technical Field

The present invention relates to processes for determining torque output and controlling power impact tools. The invention also relates to a mechanical impact wrench having electronic control.

2. Related Art

In the related art, control of power impact tools has been accomplished by directly monitoring the torque of impacts of the tool. For instance, in U.S. Pat. Nos. 5,366,026 and 5,715,894 to Maruyama et al., incorporated herein by reference, controlled impact tightening apparatuses are disclosed in which complex processes involving direct torque measurement are used. Direct torque measurement involves the measurement of the force component of torsional stress, as exhibited by a magnetic field about a tool output shaft, at the point in time of impact. From this force component, related art devices directly determine the torque applied during the impact, i.e., torque T=force F times length of torque arm r. As exemplified by FIG. 10 of U.S. Pat. No. 5,366,026, however, torque measurements fluctuate, even after a large number of impacts are applied. This phenomena is caused by the inconsistent nature of the force component of the impact. In particular, some devices measure torque at a given point in time, such that the torque measured is based on whatever force is being applied at that point in time. In other cases, the force is monitored as it rises, and is measured for peak at a point in time at which a force decrease is detected. In either case outlined above, the force may not be the peak force and, hence, the peak torque derived may not be accurate.

To rectify this problem, related art devices use weighting factors, or peak and/or low pass filtering of torque peak measurement, and/or assume, even though it is not the case, a constant driving force from the motor. For instance, in U.S. Pat. No. 5,366,026, torque measurements are used to calculate a clamping force based on the peak value of a pulsatory torque and an increasing coefficient that represents an increasing rate of a clamping force applied. Unfortunately, torque measurement accuracy remains diminished. Accordingly, there exists a need for better processes of operating power impact tools and, in particular mechanical impact tools (i.e., those with mechanical impact transmission mechanisms), with greater accuracy of torque measurement. There also exists a need for more accurate torque measurement.

Another shortcoming of the related art is the lack of an electronic control in a mechanical impact wrench.

SUMMARY OF THE INVENTION

The present invention provides an impact tool having a control system for turning off a motor at a preselected level.

The present invention provides a mechanical impact wrench comprising:

a housing;

an impact transmission mechanism within the housing;

an output shaft driven by the impact transmission mechanism;

a motor to power the transmission mechanism;

a ferromagnetic sensor measuring an output torque of the output shaft; and a control system for receiving a torque data signal from the ferromagnetic sensor, wherein the control system turns the motor off at a preselected torque level.

The present invention provides a method comprising:

providing a control system for receiving a torque data signal from a ferromagnetic sensor; and wherein the control system turns off a motor at a preselected torque level.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of the preferred embodiment.

Figure 1:
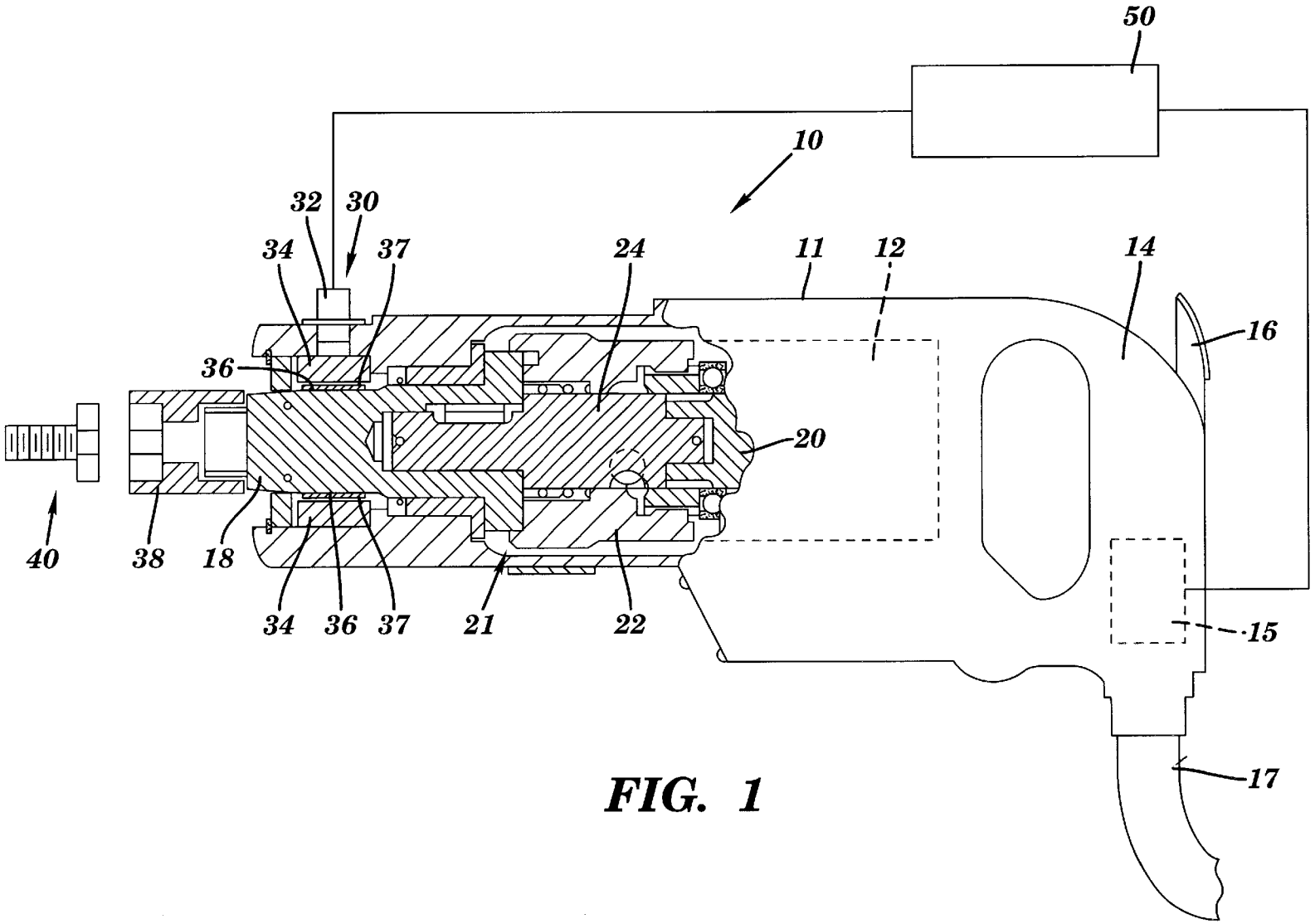
FIG. 1 shows a power tool in accordance with the present invention.

Referring to FIG. 1, a power impact tool 10 in accordance with the present invention is shown. It should be recognized that while power impact tool 10 is exemplified in the form of a mechanical impact wrench, the teachings of the present invention have applicability to a diverse range of power impact tools. Hence, although the teachings of the present invention provide particular advantages to a mechanical impact wrench, the scope of the invention should not be limited to such devices.

The power tool 10 includes a housing 11 for a motor 12 (shown in phantom), e.g., electric, pneumatic, hydraulic, etc. Housing 11 includes a handle 14 with activation trigger 16 therein. Power tool 10 also includes a mechanical impact transmission mechanism 21 having an output shaft or anvil 18, and a hammer 22, possibly coupled to output shaft or anvil 18 by an intermediate anvil 24. Hammer 22 is rotated by motor 12 via motor output 20 to physically and repetitively strike or impact output shaft or anvil 18 and, hence, repetitively transmit an impact through socket 38 to workpiece 40. It should be recognized that impact transmission mechanism 21 may take a variety of other forms that are recognized in the art and not diverge from the scope of this invention. Further, it should be recognized that socket 38 may take the form of any adapter capable of mating with workpiece 40 to output shaft 18, and that the workpiece 40 could also be varied. For instance, the workpiece could be a nut, bolt, etc.

Power tool 10 additionally includes a shutoff 15 located preferably in the handle 14. The shutoff 15, however, could be located in housing 12, or pressurized fluid supply line 17 if one is required. The pressurized fluid supply line 17 may carry any suitable substance (e.g., gas, liquid, hydraulic fluid, etc.) Shutoff 15 is activated by data processing unit or electronic control 50 to stop operation of power tool 10, as will be described below. While electronic control 50 is shown exterior to power tool 10, it may also be provided within power tool 10, if desired. If power tool 10 is a pneumatic tool, shutoff 15 is a shutoff valve. If an electric motor is used, shutoff 15 can be embodied in the form of a control switch or like structure.

Power tool 10, in the form of a mechanical impact wrench, includes a ferromagnetic sensor 30. Sensor 30 is permanently attached as shown, however, it is contemplated that the device can be replaceable for ease of repair. Sensor 30 includes a coupling 32 for connection to a data processing unit 50, a stationary Hall effect or similar magnetic field sensing unit 34, and a ferromagnetic part 36. Preferably, the ferromagnetic part 36 is a magneto-elastic ring 37 coupled to the output shaft 18 of power tool 10. Such magneto-elastic rings 37 are available from sources such as Magna-lastic Devices, Inc., Carthage, Ill. In the preferred embodiment, the magneto-elastic ring 37 surrounds or is around the output shaft 18.

The use of a separate ferromagnetic element 36, when replaceable, allows easy and complete sensor replacement without changing output shaft 18 of mechanical impact wrench 10, therefore, reducing costs. Further, the preferable use of a magneto-elastic ring 37 increases the longevity of mechanical impact tool 10 because ring 37 can withstand much larger impacts over a longer duration. It should be noted, however, that the above-presented teachings of the invention relative to the sensor are not intended to be limiting to the invention's other teachings. In other words, the embodiments of the invention described hereafter do not rely on the above-described sensor for their achievements.

Turning to the operation of power tool 10, an important feature of the invention is that sensor 30 is used to measure a time varying force signal or, in other words, the impulse of the impacts. This determination of impulse is then used to calculate torque as opposed to measuring it directly. Directly measuring torque, as in the related art, leads to inaccurate indications because of the point in time aspect of the measurement, hence, requiring the use of correction factors, peak and/or low pass filtering of torque peak measurements, or inaccurate assumptions of constant torque output. In contrast, including a time parameter which can be integrated allows for a more accurate perspective of tool activity. Since impulse is directly related to torque, the torque values corresponding to the determined impulse values can be derived to obtain more accurate torque values.

Impulse I is generally defined as the product of force F and time t. As used in the present invention, impulse I is equationally represented as:

$$I = \int_{ti}^{tf} F dt$$

Where F is the force of the impact, dt is the differential of integration of time from $t_i$, the time of integration initiation, to $t_f$, the time of integration conclusion. Impulse, as used herein, is the integration of the product force and time over a desired time duration. It should be recognized that there are a variety of ways of setting $t_i$ and $t_f$. For instance, in the preferred embodiment, data is continuously streamed into a buffer in data processing unit or electronic control 50. When an impact is detected, $t_i$ is set to be impact minus some number (x) of clock counts, and $t_f$ is set to be impact plus some number (y) of clock counts. The parameters (x) and (y) are dependent on the tool used. As a result, a window of the force is created from $t_i$ to $t_f$ which can be integrated to derive an impulse value.

Torque is preferably derived from the determination of impulse as follows. Impulse I is also equivalent to change in linear momentum $\Delta\rho$, i.e., $I=\Delta\rho$. Linear momentum $\rho$ can be converted to angular momentum L by taking the vector product of the impulse I and length of a torque arm r, i.e., $L=r \times \rho$. Torque T, while generally defined as force times length of torque arm r, can also be defined in terms of the time rate of change of angular momentum on a rigid body, i.e., $\Sigma T=dL/dt$. Accordingly, impulse I can be converted to torque T using the following derivation:

$$T=d(Ir)/dt$$

Therefore, the torque acting over the time duration t of the impact is $T=Ir/t$. Knowing the impulse I, the torque arm r, and the time duration t, an accurate measure of torque T can be derived from a determination of the impulse. The impulse value I can also be multiplied by a coefficient of proportionality C prior to determination of the torque T. The coefficient of proportionality C is a predetermined value based on the size of the particular tool, e.g., it may vary based on area of magnetic field and manufacturing tolerance.

Figure 2A:
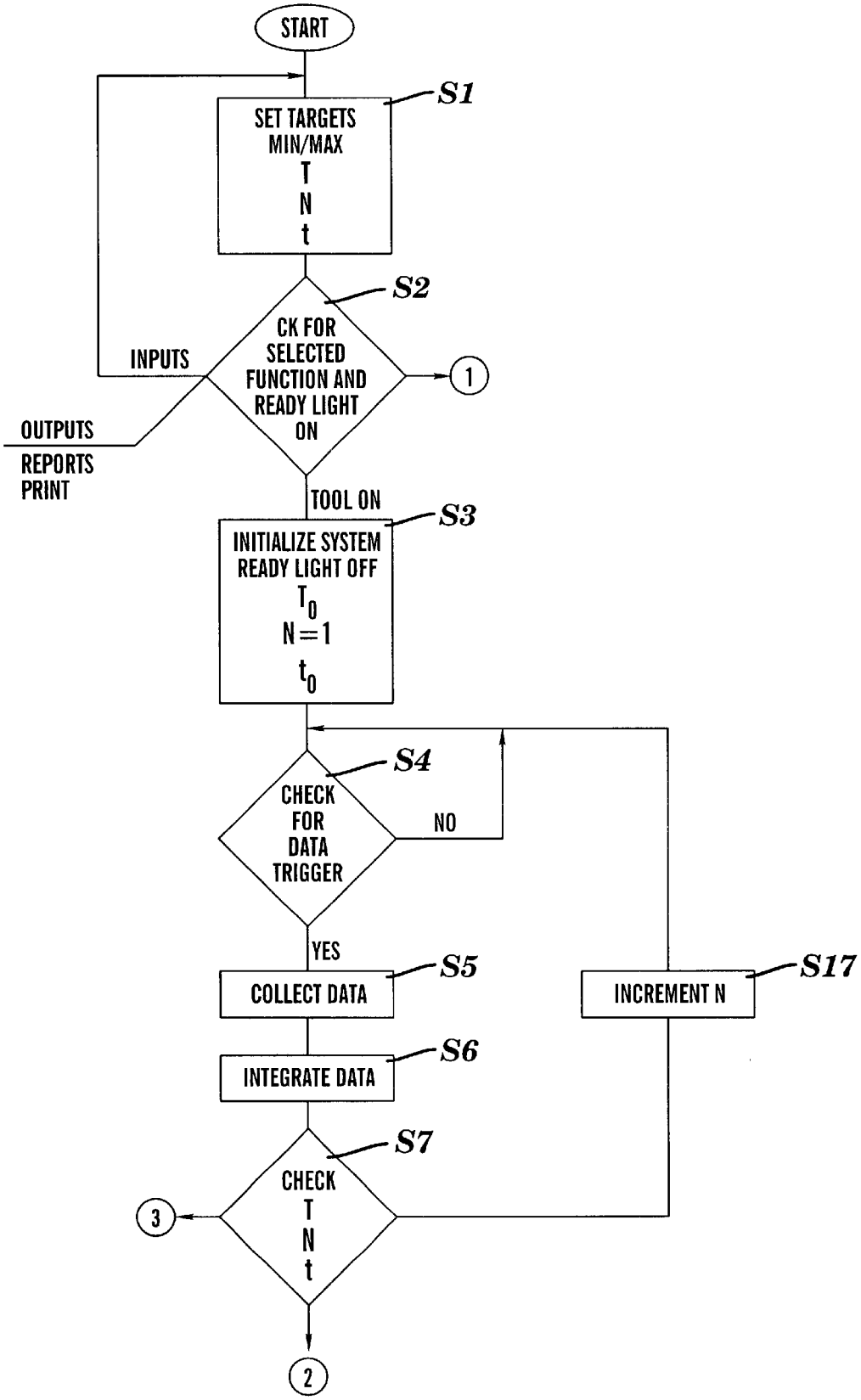
FIGS. 2A–2C show a flowchart of the processes in accordance with the present invention.
Figure 2B:
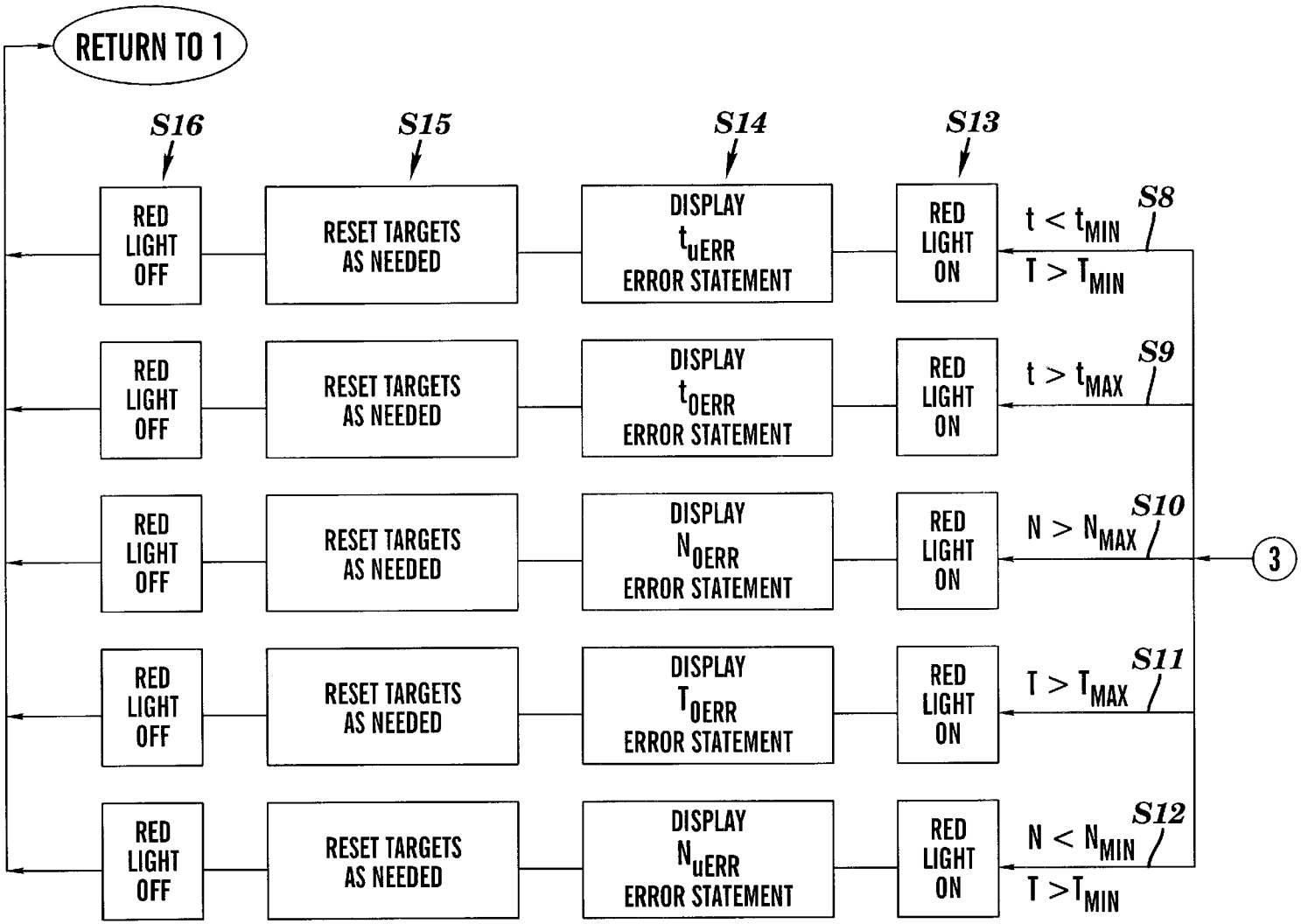
Figure 2C:
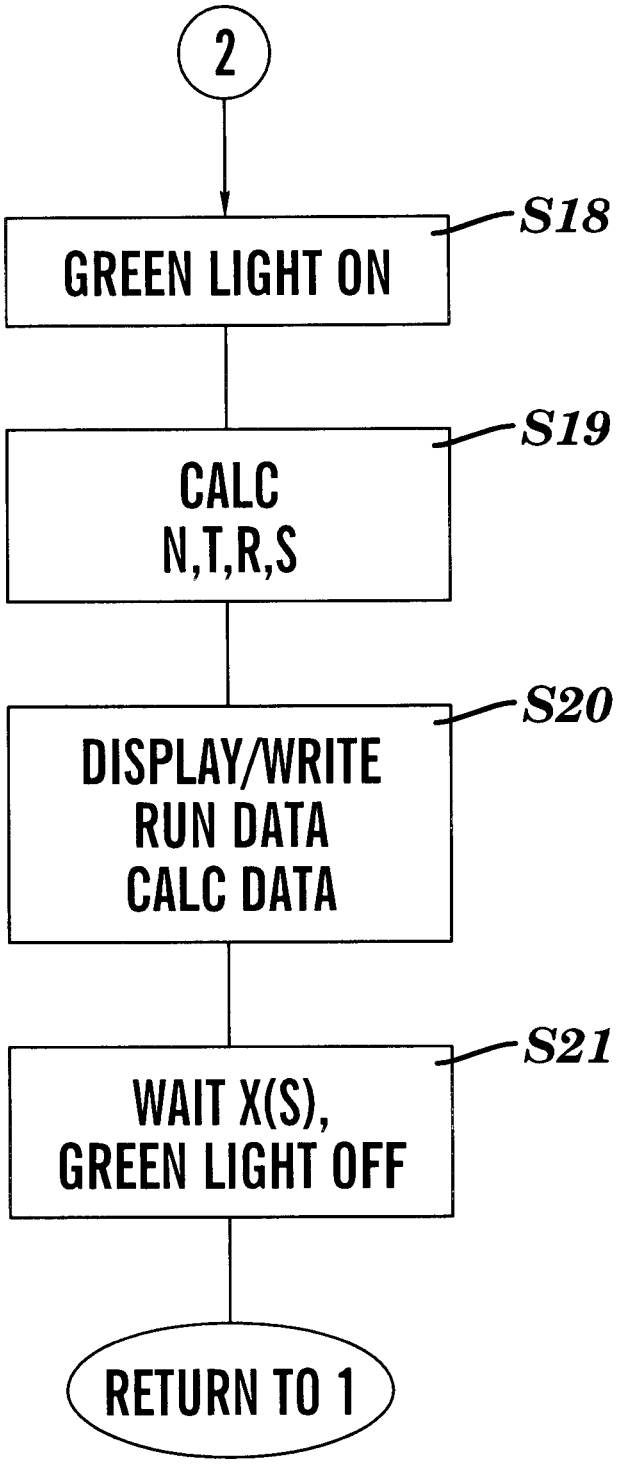

FIGS. 2A–2C show a flowchart diagram of process embodiments of the present invention. In step S1, the user of the power tool 10 inputs selected parameter standards, or targets, for the given workpiece 40. "Standards" refers to individual target values, i.e., maximum allowable torque $T_{max}$, minimum number of impacts $N_{min}$, etc., or desired target value ranges, i.e., $T_{min}<T<T_{max}$, $N_{min}<N<N_{max}$, or $t_{min}<t<t_{max}$, etc. While in the preferred embodiment, torque T is the main parameter for tool control and two cross-checking parameters (i.e., impact number N and time duration t) are used, it should be recognized that other parameters can be measured and used for cross checking proper operation on a given workpiece.

Next, in step S2, the system is queried for: operational inputs, e.g., standards outlined above; outputs/reports to be generated and/or printed; data to be stored and/or reviewable; and whether the user is ready to use the tool. A ready light may be used to indicate the tool readiness for operation or to receive data. If the ready indication is not triggered, the process loops until a ready indication is given. When a ready indication is given, the process progresses to step S3 where the parameters to be measured are initialized, i.e., values of torque $T_o$, and impact time duration $t_o$ are set to 0, and the number of impacts N is set to 1.

At step S4, the in-operation process loop of power tool 10 begins. Monitoring of sensor 30 output is constant except when the standards are met or an error indication is created, as will be described below. The in-operation process loop begins when the monitoring of sensor 30 indicates operation of the tool by sensing an impact. Because an impact threshold occurs sometime after the start of an impact, a window of the data (which is collected in a buffer of electronic control 50) from the monitoring of sensor 30 that spans the impact threshold is used. As discussed above, when an impact is detected, $t_i$ is set to be impact minus some number of clock counts. Accordingly, when an initial impact is sensed, the system can go back (x) clock counts to determine where the in-operation processing should begin. If no operation is sensed, the process loops until operation is sensed.

When operation is activated, the process proceeds to step S5 where data collection is made. In the preferred embodiment, impulse I, number of impacts N, and time duration t are measured. Impulse I is created by integrating over time the force applied as described above. Torque T is then calculated or derived from impulse I according to the above described derivation at step S6.

Next, as shown in FIG. 2A, at step S7, and FIG. 2B steps S8–S12, the data collected is compared to inputted standards, or a combination thereof. Specifically, at step S9, a determination of whether $t>t_{max}$ is made; at step S10, a determination of whether $N>N_{max}$ is made; and at step S11, a determination of whether $T>T_{max}$ is made. Combinations of standard checking can be advantageous also. For example, at step S8, determinations of whether $t<t_{min}$ and $T>T_{min}$ are made; and at step S12, determinations of whether $N<N_{min}$ and $T>T_{min}$ are made. Other comparisons are also possible.

As indicated at step S13, when the standards are not met, a red error light is turned on. Simultaneously, electronic control 50 activates shutoff 15 and operation stops. At step S14, an appropriate error signal is created depending on which parameter is violated, e.g., $T_{oerr}$, $N_{oerr}$, $t_{oerr}$, $T_{uerr}$, $N_{uerr}$, $t_{uerr}$, etc. The subscript "oerr" symbolizes that a maximum value, e.g., $T_{max}$, was exceeded, and the subscript "uerr" symbolizes that a minimum value, e.g., $N_{min}$, was not met. Error statements that do not indicate whether the error is based on high or low violation also could be used, e.g., $t_{err}$. At step S15, any necessary target resets are produced. At step S16, the red light is turned off and the process then returns to step S2 to begin operation again, if desired.

Preferably, control of power tool 10 is based on torque T, as derived from impulse I, alone. As mentioned above, however, the use of multiple standards and multiple standard checking allows for a cross-checking for proper operation on a given workpiece. A possible inappropriate outcome on, for example, a bolt and nut workpiece is where the bolt and nut are cross threaded. In this example, where torque measurements indicate a proper connection, number of impacts N may not meet standards, thus indicating the presence of cross threading.

If no error is indicated at steps S7–S12, operation of the tool loops back to step S4. During the loop, at step S17, the number of impacts N is incremented by one.

Through steps S7–S12, the system also determines when the standards are satisfactorily met. That is, when $T_{min}<T<T_{max}$; $N_{min}<N<N_{max}$; and $t_{min}<t<t_{max}$, etc., are satisfied. When this occurs, the process proceeds to step S18, as shown in FIG. 2C. At step S18, a green light is turned on indicating proper operation on the workpiece, and simultaneously tool operation is stopped by electronic control 50 activating shutoff 15.

At step S19, statistical analysis of the operation is conducted. For instance, the final number of impacts N, the average torque T applied, the range R of torque T applied, or standard deviation S can be calculated. It should be noted that other processing of data can occur and not depart from the scope of the invention. For example, statistical values such as: mean average, ranges, and standard deviations, etc., of all measured parameters can be calculated, if desired. Further, error indicators can also be created based on these statistical values, if desired.

At step S20, the data gathered and/or calculated is displayed and/or written to data storage, as desired.

At step S21, the process waits X(s) amount of time before turning off the green light and proceeding to step S2 for further operation as desired by the user. The process then returns to step S2 to begin operation again.

The above process of measuring impulse and deriving torque values therefrom provides a more accurate control of power tool 10.

Figure 3:
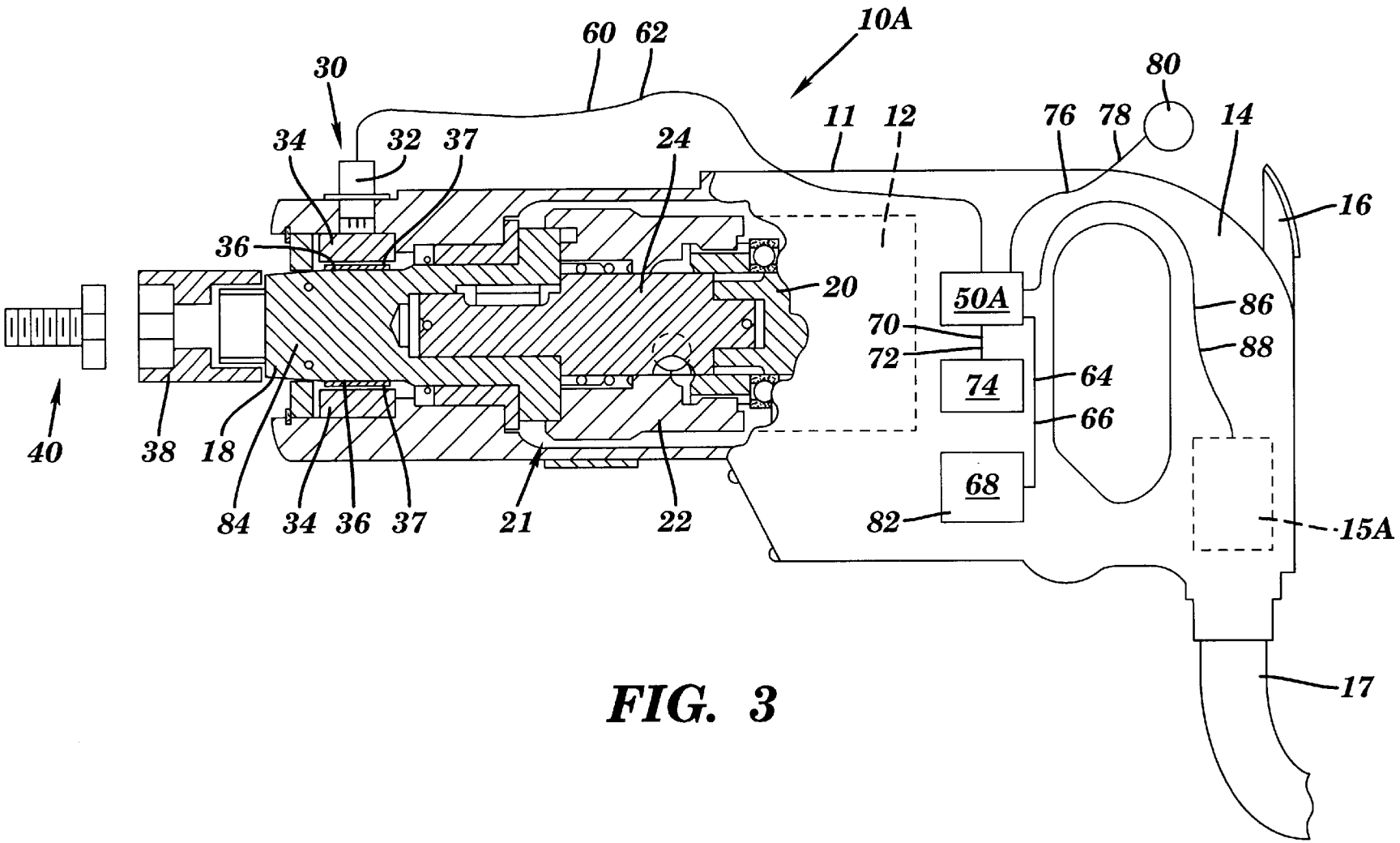
FIG. 3 shows another embodiment of a power tool including a ferromagnetic sensor for measuring an output torque of an output shaft and a control system for turning the motor off at a preselected torque level.

FIG. 3 shows another embodiment of a power tool 10A. The power tool 10A includes a housing 11 for a motor 12 (shown in phantom). The motor 12 may comprise any suitable drive means (e.g., electric, pneumatic, hydraulic, etc.). The housing 11 includes the handle 14 with the activation trigger 16 therein. The power tool 10A also includes the mechanical impact transmission mechanism 21 having the output shaft or anvil 18, and the hammer 22, selectively coupled to the output shaft or anvil 18 by the intermediate anvil 24. Hammer 22 is rotated by the motor 12 via the motor output 20 to physically and repetitively strike or impact the output shaft or anvil 18 and, hence, repetitively transmit an impact through socket 38 to the workpiece 40. It should be recognized that impact transmission mechanism 21 may take a variety of other forms that are recognized in the art and not diverge from the scope of this invention. Further, it should be recognized that socket 38 may take the form of any adapter capable of mating workpiece 40 to output shaft 18, and that the workpiece 40 could also be varied. For instance, the workpiece 40 could be a nut, bolt, etc.

The power tool 10A includes a switch 15A located in the handle 14. The switch 15A, however, could be located in the housing 12, or pressurized fluid supply line 17 if one is required. The switch 15A is included in a control system 50A. The switch 15A is activated by the control system 50A to stop operation of the power tool 10A. The control system 50A may be located within the power tool 10A, or may be exterior to the power tool 10A. If the power tool 10A is a pneumatic tool, the switch 15A is a shutoff valve. If an electric motor is used, the switch 15A may comprise an electrical control switch.

The power tool 10A, in the form of a mechanical impact wrench includes a torque transducer such as the ferromagnetic sensor 30. The ferromagnetic sensor 30 is permanently attached as shown, however, the ferromagnetic sensor 30 may be replaceable for ease of repair. Ferromagnetic sensor 30 includes the coupling 32 for connection to the control system 50A, a stationary Hall effect or similar magnetic field sensing unit 34, and a ferromagnetic part 36. The ferromagnetic part 36 may be a magneto-elastic ring 37 coupled to the output shaft 18 of the power tool 10A. Such magneto-elastic rings 37 are available from sources such as Magna-lastic Devices, Inc., Carthage, Ill. The magneto-elastic ring 37 may surround or is around the output shaft 18.

The use of a separate ferromagnetic element 36, when replaceable, allows easy and complete sensor replacement without changing output shaft 18 of the mechanical impact wrench 10A, therefore, reducing costs. Further, the preferable use of the magneto-elastic ring 37 increases the longevity of mechanical impact tool 10A because ring 37 can withstand much larger impacts over a longer duration.

In the power tool 10A, the ferromagnetic sensor 30 measures an output torque level 84 in the output shaft 18. A conduit 60 carries a torque data signal 62 including the output torque level 84 to the control system 50A. A conduit 64 carries input data 66 from an input device 68 to the control system 50A. A conduit 70 carries output data 72 to an output device 74. A conduit 76 carries power 78 from a power supply 80 to the control system 50A. The power supply 80 may be any suitable source (e.g., a battery, a solar cell, a fuel cell, an electrical wall socket, a generator, etc.). The input device 68 may be any suitable device (e.g., touch screen, keypad, etc.). An operator may input a preselected torque level 82 into the input device 68. The preselected torque level 82 is carried through the conduit 64 to the control system 50A. The control system 50A may transmit output data 72 through conduit 70 to the output device 74. The output data 72 may include the preselected torque level 82 or the output torque level 84 from the output shaft 18. The output device 68 may be any suitable device (e.g., screen, liquid crystal display, etc.). The control system 50A sends a switch control signal 86 through a conduit 88 to the switch 15A. The operator uses the activation trigger 16 to turn the switch 15A on and the control system 50A turns the switch 15A off when the preselected torque level 82 is reached in the output shaft 18.

Figure 4:
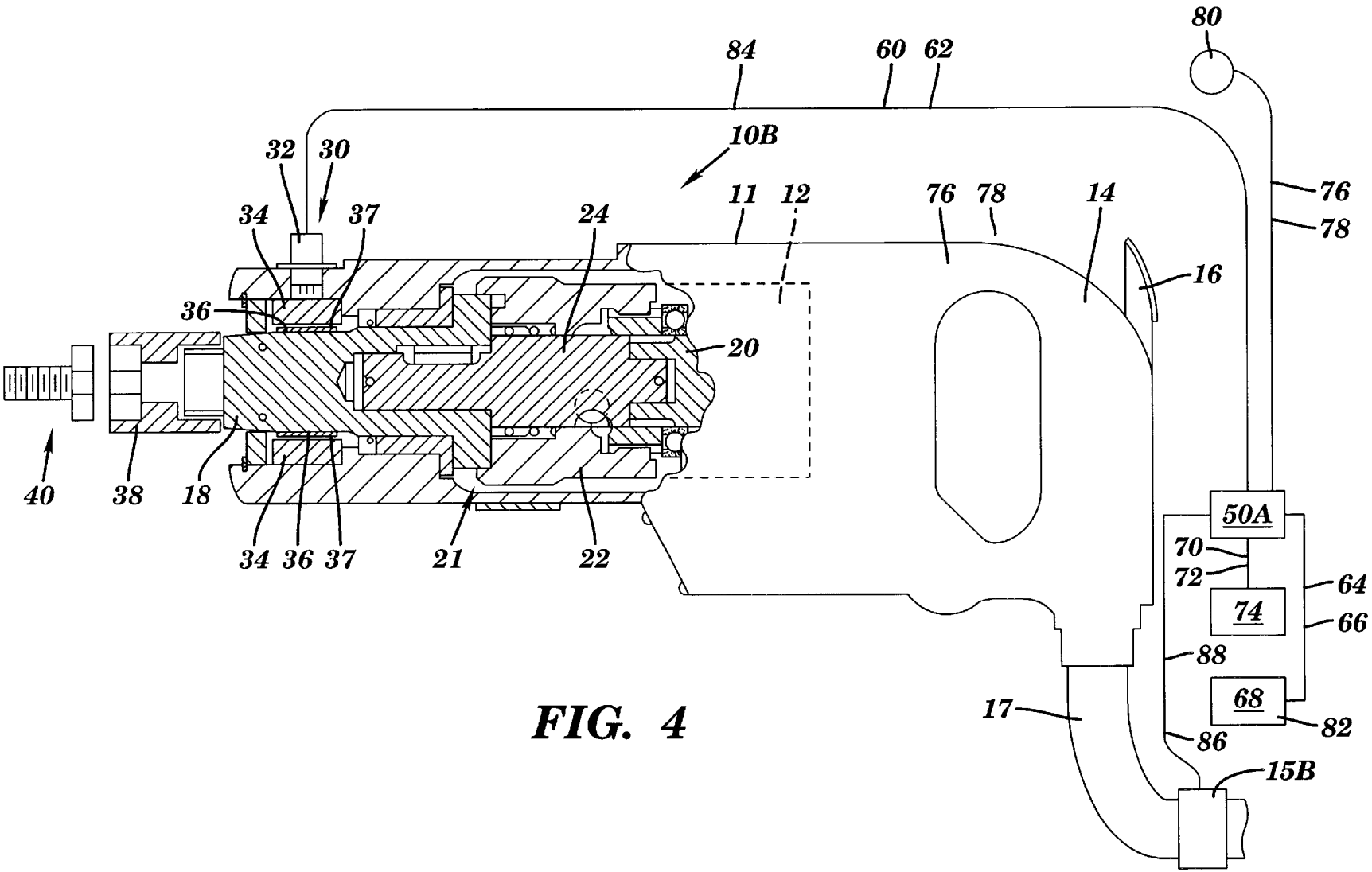
FIG. 4 shows another embodiment of a power tool including an input device for inputting the preselected torque level located external from the housing.

FIG. 4 shows another embodiment of a power tool 10B similar to the power tool 10A, except the control system 50A, the output device 74, the input device 68, and a switch 15B are external to the housing 11 of the power tool 10B. The switch 15B is in line with the supply line 17. The switch 15B may include (e.g., a shut off valve, a solenoid valve, an electrical switch, a slide valve, a poppet valve, etc.). As in the power tool 10A, the preselected torque level 82 is entered into the control system 50A using the input device 68. The control system 50A turns off the switch 15B when the output torque level 84 reaches the preselected torque level 82. The switch 15B stops the flow in the supply line and the motor 12 stops.

Figure 5:
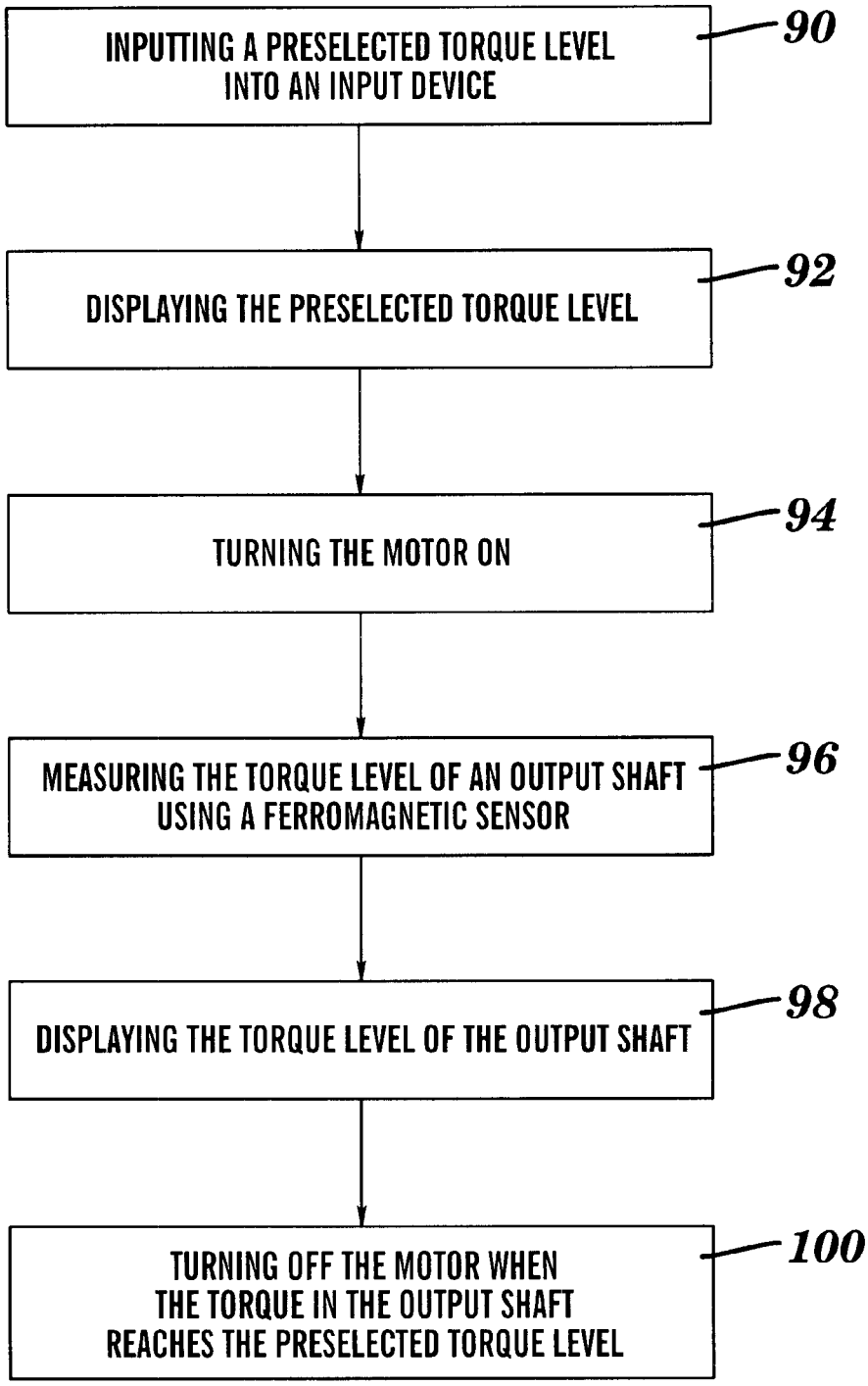
FIG. 5 shows a schematic view of the control system for turning off the power tool when a preselected torque level is reached.

FIG. 5 shows a schematic view of the steps in using the power tool 10A, 10B. In step 90, an operator inputs the preselected torque level 82 into the input device 68. In step 92, the preselected torque level 82 is displayed on the output device 74. In step 94, the motor 12 is turned on using the activation trigger 16. In step 96, the control system 50A using the ferromagnetic sensor 30, measures the output torque level 84. In step 98 the control system 50A displays the output torque level 84 on the output device 74. In step 100, the control system 50A turns off the motor 12 when the output torque level 84 in the output shaft 18 reaches the preselected torque level 82.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

While embodiments of the present invention have been described herein for purposes of illustration, many modifications and changes will become apparent to those skilled in the art. For example, the torque transducer 30 may include any suitable sensor (e.g., ferromagnetic, resistive, optical, inductive, etc.). Accordingly, the appended claims are intended to encompass all such modifications and changes as fall within the true spirit and scope of this invention. In particular, it should be noted that the teachings of the invention regarding the determination of torque using measurements from a torque transducer are applicable to any power impact tool and that the above description of the preferred embodiment in terms of a mechanical impact tool and, more particularly, to a mechanical impact wrench should not be considered as limiting the invention to such devices.

I claim:

1. A method, comprising:

measuring a signal relating to a time-varying force over a time interval, said time-varying force over said time interval imparting a torque to an output shaft of a power tool; and determining said torque from said measured signal over said time interval.

2. The method of claim 1, wherein said determining comprises integrating said signal over said time interval.

3. The method of claim 2, wherein said measuring comprises measuring said signal by a ferromagnetic sensor that is coupled to said output shaft.

4. The method of claim 3, wherein said ferromagnetic sensor comprises a magnetic field sensing unit.

5. The method of claim 4, wherein said ferromagnetic sensor further comprises a ferromagnetic part that includes a magneto-elastic ring.

6. The method of claim 3, wherein said ferromagnetic sensor is coupled to a data processing unit or electronic control adapted to stop operation of the power tool.

7. The method of claim 2, wherein said torque on said output shaft generates a torque on a workpiece to which the output shaft is coupled.

8. The method of claim 1, wherein said measuring comprises measuring said time-varying signal by a ferromagnetic sensor that is coupled to said output shaft.

9. The method of claim 8, wherein said ferromagnetic sensor comprises a magnetic field sensing unit.

10. The method of claim 9, wherein said ferromagnetic sensor further comprises a ferromagnetic part that includes a magneto-elastic ring.

11. The method of claim 8, wherein said ferromagnetic sensor is coupled to a data processing unit or electronic control adapted to stop operation of the power tool.

12. The method of claim 1, further comprising generating from said torque on said output shaft a torque on a workpiece to which the output shaft is coupled.

13. The method of claim 12, wherein the output shaft is coupled to the workpiece through an adapter mating with said workpiece, said adapter being comprised by said power tool.

14. The method of claim 1, wherein said power tool is a mechanical impact wrench.

15. An apparatus, comprising:

measuring means for measuring a signal relating to a time-varying force over a time interval, said time-varying force over said time interval imparting a torque to an output shaft of a power tool; and determining means for determining said torque from said measured signal over said time interval.

16. The apparatus of claim 15, wherein said determining means comprises means for integrating said signal over said time interval.

17. The apparatus of claim 16, wherein said measuring means comprises a ferromagnetic sensor coupled to said output shaft.

18. The apparatus of claim 17, wherein said ferromagnetic sensor comprises a magnetic field sensing unit.

19. The apparatus of claim 18, wherein said ferromagnetic sensor further comprises a ferromagnetic part that includes a magneto-elastic ring.

20. The apparatus of claim 17, wherein said ferromagnetic sensor is coupled to a data processing unit or electronic control adapted to stop operation of the power tool.

21. The apparatus of claim 16, wherein said torque on said output shaft generates a torque on a workpiece to which the output shaft is coupled.

22. The apparatus of claim 15, wherein said measuring means comprises a ferromagnetic sensor coupled to said output shaft.

23. The apparatus of claim 22, wherein said ferromagnetic sensor comprises a magnetic field sensing unit.

24. The apparatus of claim 23, wherein said ferromagnetic sensor further comprises a ferromagnetic part that includes a magneto-elastic ring.

25. The apparatus of claim 22, wherein said ferromagnetic sensor is coupled to a data processing unit or electronic control adapted to stop operation of the power tool.

26. The apparatus of claim 15, wherein said torque on said output shaft generates a torque on a workpiece to which the output shaft is coupled.

27. The apparatus of claim 26, wherein the output shaft is coupled to the workpiece through an adapter mating with said workpiece, said adapter being comprised by said power tool.

28. The apparatus of claim 15, wherein said power tool is a mechanical impact wrench.

29. A power tool comprising:

a motor;

an output shaft, operatively attached to said motor, such that said output shaft receives a time-varying force over a time-interval;

a sensor, operatively attached to receive data from said output shaft, said data relating to said time-varying force; and a data processor for processing said data.

30. The power tool of claim 29, further comprising:

an output device for outputting said processed data.

31. The power tool of claim 30, wherein the processed data is torque data.

32. The power tool of claim 29, further comprising:

an input device for inputting a preselected torque level on said output shaft.

33. The power tool of claim 29, wherein said time-varying force is an impulse signal.

34. The power tool of claim 29, wherein said motor is selected from the group consisting of electric, pneumatic and hydraulic motors.

35. The power tool of claim 29, further comprising an impact transmission mechanism.

36. The power tool of claim 35, wherein the output shaft is an anvil and the impact transmission mechanism is a hammer.

37. The power tool of claim 29, wherein said power tool is an impact wrench.

38. The power tool of claim 29, wherein the sensor is a ferromagnetic sensor.

39. The power tool of claim 29, further comprising a control system, wherein said control system activates a switch to turn off the motor at a preselected torque.

* * * * *